US006092456A

United States Patent [19]

Noda et al.

[11] Patent Number: 6,092,456

[45] Date of Patent: Jul. 25, 2000

[54] RODLESS POWER CYLINDER

[75] Inventors: Mitsuo Noda, Ichinomiya; Tsuyoshi Yonezawa, Nakashima-gun, both of Japan

[73] Assignee: Howa Machinery, Ltd., Nagoya, Japan

[21] Appl. No.: 09/094,029

[22] Filed: Jun. 9, 1998

[30] Foreign Application Priority Data

Jun. 11, 1997 [JP] Japan ..... 9-171115
Jun. 19, 1997 [JP] Japan ..... 9-180343

[51] Int. Cl.[7] ..... F01B 29/00

[52] U.S. Cl. ..... 92/88; 92/85 R; 277/567; 277/644

[58] Field of Search ..... 92/85 R, 88, 165 PR, 92/177; 277/560, 567, 630, 644, 910

[56] References Cited

U.S. PATENT DOCUMENTS 5,241,897 9/1993 Drittel ..... 92/88
5,473,971 12/1995 Takeuchi et al. ..... 92/88

*Primary Examiner*—Edward K. Look
*Assistant Examiner*—Thomas E. Lazo
*Attorney, Agent, or Firm*—Finnegan, Henderson, Farabow, Garrett & Dunner, L.L.P.

[57] ABSTRACT

A rodless power cylinder includes a tube having an oblong circular cross section bore and a slit extending along the longitudinal axis of the bore and penetrating the wall of the tube. The bore includes a slit-side inner surface on which the slit opens and a counter-slit-side inner surface which opposes the slit-side inner surface. The slit-side inner surface of the bore is formed as a flat plane or a curved plane having substantially no curvature. Further, recesses are formed on the slit side inner surface at both sides of the slit. The surfaces of the recesses are formed as curved planes having a curvature larger than the curvature of the slit-side inner surface. An inner seal band made of a flat, thin metal band is provided to seal the opening of the slit. The seal band contacts the surface of the recess at its transverse edges. Therefore, a good sealing capability is achieved by the contacts between the surfaces of the recesses and the edges of the seal band.

15 Claims, 13 Drawing Sheets

RODLESS POWER CYLINDER

BACKGROUND OF THE INVENTION

1. Field of the Invention

The present invention relates to a rodless power cylinder having a piston disposed in a tube and moving along the axis of the tube and an external moving body disposed outside the tube and coupled to the piston through a slit formed on the wall of the tube. More specifically, the present invention relates to a rodless power cylinder provided with a bore having a non-circular cross section and the slit-side inner surface on which the slit is formed has a substantially no or a very small curvature.

2. Description of the Related Art

A rodless power cylinder includes a tube (a cylinder barrel) having an axial slit in the wall and a piston disposed in the bore of the tube and is movable along the longitudinal axis of the tube. The movement of the piston is transferred to an external moving body by a member which couples the external moving body to the piston through a slit formed on the wall of the tube along the longitudinal axis thereof. Usually, an inner seal band and an outer seal band are disposed on the inner and the outer wall surfaces of the tube along the slit in order to cover the inner and the outer openings of the slit.

Rodless power cylinders having non-circular cross sections such as elliptical cross sections or oblong circular cross sections are disclosed in various publications.

For example;

(A) Japanese Unexamined Patent Publication (Kokai) No. 50-89775 discloses a rodless power cylinder including a bore having a substantially rectangular cross section. The slit-side inner surface of the bore is formed as a flat plane, and the slit is sealed by a thin metal band which contacts the flat slit-side inner surface in face-to-face contact.

(B) Japanese Unexamined Utility Model Publication (Kokai) No. 1-104407 and Japanese Unexamined Utility Model Publication (Kokai) No. 1-180001 discloses rodless power cylinders having non-circular bores. In the rodless power cylinders of these publications, the openings of the slits on the inner surface of the bore are widened in order to form grooves for accommodating elastomer seal bands. The elastomer seal bands fitted into the grooves have a relatively large thickness.

(C) Japanese Unexamined Patent Publication (Kokai) No. 62-46009 discloses a rodless power cylinder having a circular cross section bore. In the rodless power cylinder, though the bore has a circular cross section, the portion of the inner surface of the bore on both sides of the slit is formed as a recess having a curvature larger than the curvature of the surface of the bore. A thin inner seal band having a curvature matching the curvature of the recess is used to seal the opening of the slit.

(D) Japanese Unexamined Patent Publication (Kokai) No. 54-28978 discloses a rodless power cylinder having a tube with a substantially circular cross section. The whole slit-side inner surface of the bore has a curvature smaller than the outer wall of the tube and the recess is not formed on the slit-side inner surface at the portion of the slit opening. The inner seal band is formed as a thin flat belt and is deflected into the slit by the internal fluid pressure of the bore. The internal pressure is sealed by the contact between the transverse edges of the seal band and the slit-side inner surface.

(E) Japanese Unexamined Patent Publication (Kokai) No. 56-124711 discloses an arrangement of the piston packing disposed at piston ends of a rodless power cylinder. The piston packing in this publication is formed as an annular shape and has an outer lip contacting with the inner surface of the bore. The portion of the periphery of the outer lip has a complementary shape of the inner surface of the seal band.

(F) Japanese Unexamined Utility Model Publication (Kokai) No. 1-180001 discloses another type of piston packing. The piston packing in this publication is also formed as an annular shape and has an outer lip. However, in this publication, bridges connecting the outer lip and an inner lip (a base portion) of the packing are provided at the portions corresponding to the edges of the inner seal band. These bridges increase the force for urging the edges to the inner surface of the bore in order to increase the sealing capability of the seal band.

(G) Japanese Unexamined Patent Publication (Kokai) No. 1-6505 discloses an arrangement of dampers for receiving the piston at its stroke ends. In this publication, the dampers are attached to end members which close both ends of the tube. The end members are provided with holes on the faces opposing the piston ends for fitting rod-shaped rubber dampers. The rod-shaped rubber dampers have stepped diameter portions and are fitted to the end members by inserting the larger diameter ends into the holes on the end members. When the piston hits the smaller end of a damper at its stroke end, the rubber damper resiliently deflects in the axial direction and the diameter thereof expands to, thereby, absorb the kinetic energy of the piston until the piston stops.

(H) Japanese Unexamined Patent Publication (Kokai) No. 63-190909 discloses another type of damper for a rodless power cylinder. The damper (an external damper) or the shock absorber in this publication is fitted to the outer wall of the tube using fitting brackets. The external damper receives the external moving body at piston stroke ends to absorb the kinetic energy of the external moving body and the piston.

(I) Japanese Unexamined Patent Publication (Kokai) No. 7-269514 discloses an arrangement of cylinder gasket interposed between the inner surface of the bore and an insert portion of the end member which is inserted into the bore. The cylinder gasket in this publication is fitted into a groove formed on the periphery of the insert portion of the end member. A bulging portion is formed on the bottom of the groove at the portion facing the inner seal band in order to press the cylinder gasket to the seal band with higher pressure than the other portions of the cylinder gasket.

However, the rodless power cylinders in the publications (A) through (I) have various disadvantages.

For example, in the publication (A), the inner seal band of a thin metal belt is pressed against the flat inner surface of the bore in order to obtain a face-to-face contact between the seal band and the inner surface. Therefore, the roughness of the bore surface and the surface of the inner seal band must be kept small in order to obtain a good seal performance. Therefore, the surfaces of the bore and the inner seal band must be machined to a high accuracy. This increases the manufacturing cost of the rodless power cylinder.

Further, since the rodless power cylinder in the publication (B) uses an elastomer seal band having a large thickness instead of a thin metal seal band, the groove deep enough to accommodating the thick elastomer seal band must be formed on the slit-side inner surface. This causes the thickness of the wall of the tube to increase and make it difficult to reduce the height (the thickness) of the tube even if a non-circular flat bore is used.

The rodless power cylinder in the publication (C) uses a tube having a circular cross section bore. Therefore, it is difficult to reduce the height of the tube. Further, the rodless power cylinder in this publication uses a thin metal inner seal band formed as an arc of a circle having a center on the longitudinal axis of the tube. Since this seal band is guided by guide rollers, the seal band is flattened when it is guided by the rollers. Therefore, the seal band is deflected by the rollers when it contacts the rollers. This lowers the durability of the seal band.

Further, since both of the contact surfaces of the recess receiving the seal band and the surface of the seal band are curved, the curvatures of both contact surfaces must strictly match each other in order to obtain a good seal performance. This requires a higher accuracy in machining the surfaces of the recess and the seal band. In addition, when the curved seal band is used, it is difficult to accurately predict the deflection of the seal band caused by the internal pressure. Therefore, it is difficult to estimate the seal performance precisely when designing the seal band. These problems make it difficult to apply the seal band in the publication (C) to the actual rodless power cylinder from the practical viewpoint.

The rodless power cylinder in the publication (D) uses a tube having a circular cross section. Therefore, it is also difficult to reduce the height of the tube. Further, the sealing capability of the seal band in this publication is determined by the contact pressure between the edges of the seal band and the slit-side inner surface, i.e., determined by the amount of the deflection of the seal band. Further, since the amount of the deflection of the seal band varies in accordance with the curvature of the slit-side inner surface, and the curvature of the slit-side inner surface varies in accordance with the diameter of the tube, the desired deflection of the seal band for achieving a maximum sealing capability must be newly calculated in order to use a tube of a different diameter.

The piston packing used in the publication (E) seals the internal pressure by the outer lip pressed against the inner surface of the bore only by the internal pressure. Therefore, when the internal pressure is low, the sealing capability of the piston packing becomes insufficient.

Further, in the piston packing of the publication (F), the bridges connecting the outer lip and the inner lip adversely affect the sealing capability of the piston packing when the internal pressure is high. When the internal pressure is high, the force exerted on the outer lip to press the outer lip against the inner surface of the bore becomes high. However, in the piston packing of this publication, since a part of this force is received by the bridge and the force to press the outer lip against the inner surface becomes insufficient. This causes insufficient sealing capability when the internal pressure is high.

The publication (G) discloses the arrangement of the damper for the piston. Though the piston is smoothly stopped by the damper in this publication, the external moving body connected to the piston by the coupling member (a yoke) itself is not stopped. Therefore, when the piston hits the damper at its stroke end, a large bending moment is exerted on the yoke by the momentum of the external moving body.

When the external damper in the publication (H) is used, the momentum of the external moving body can be absorbed by the external damper and the bending moment exerted on the yoke becomes smaller. However, since the momentum of the external moving body is large, a large shock-absorbing capability is required for the external damper or the shock absorber. This causes an increase in the manufacturing cost of the rodless power cylinder. Further, even if an external damper having an enough shock-absorbing capacity is used, a large noise is generated when the external moving body hits the external damper.

In the rodless power cylinder of the publication (I), the bulging portion is provided on the bottom surface of the groove to press the cylinder gasket against the seal band with a larger force. However, due to the elasticity of the cylinder gasket, the cylinder gasket does not closely contact with the bottom of the groove at both sides of the bulging portion. This causes the leak of the fluid through both sides of the bulging portion.

Further, since the portion of the cylinder gasket corresponding to the position of the seal band is pressed against the seal band by a larger force, the permanent deformation of the gasket becomes large at this portion. This causes the deterioration of the cylinder gasket.

Further, in order to form the bulging portion on the groove bottom of the insert portion, the shape of the die used for casting the end member becomes complicated. This also causes the increase in the manufacturing cost of the rodless power cylinder.

SUMMARY OF THE INVENTION

In view of the problems in the related art as set forth above, one of the objects of the present invention is to provide a rodless power cylinder in which the height of the tube is reduced by using the tube with a non-circular cross section bore while maintaining a high sealing capability of the inner seal band.

Further, another object of the present invention is to provide a rodless power cylinder in which steps for designing the seal for the slit can be reduced.

Further, another object of the present invention is to provide a rodless power cylinder equipped with a piston packing capable of maintaining a good sealing capability over a wide range of the internal pressure without hampering the movement of the piston.

Another object of the present invention is to provide a rodless power cylinder equipped with a damper capable of stopping the movements of the piston and the external moving body without causing a large bending moment on the yoke while keeping the manufacturing cost low.

Another object of the present invention is to provide a rodless power cylinder equipped with a cylinder gasket having a high sealing capability without increasing the manufacturing cost largely.

One or more of the objects as set forth above are achieved by a rodless power cylinder, according to the present invention, comprising a tube provided with bore and a slit which penetrates the wall of the tube and extends in parallel to the longitudinal axis of the tube, the bore having a non-circular cross section and including a slit-side inner surface on which the slit is formed and a counter-slit-side inner surface which opposes the slit-side surface, a piston having a non-circular cross section and disposed in the bore of the tube and movable therein along the direction of the longitudinal axis of the tube, the piston provided with piston packings at both ends thereof, an external moving body disposed outside of the tube and coupled to the piston through the slit so that the external moving body moves with the piston along the slit, an inner seal band extending along the slit and covering the slit from the inside of the bore wherein, the slit-side inner surface of the bore on the plane perpendicular to the longitudinal axis of the tube having substantially no curvature and the portion on the slit-side inner surface on both sides of the slit formed as a recess for contacting the transverse edges of the inner seal band and wherein the inner surfaces of the recess on both sides of the slit have a curvature larger than the curvature of the slit-side inner surface.

According to the present invention, since the sealing of the slit opening is achieved by the contact between the transverse edges of the inner seal band and the surface of the recess, flatness of the surface of the recess is required only for the portion contacting the edges of the seal band. Therefore, the manufacturing process of the tube can be simplified. This is especially advantageous when manufacturing tubes having non-circular cross section bores.

Further, since a flat inner seal band is used in the present invention, the resilient force caused by the deflection of the seal band which presses the edges of the seal band against the surface of the recess is easily calculated compared to the case where a curved inner seal band is used. In addition to that, since the deflection of the inner seal band when the internal pressure is exerted thereon is determined by the curvature of the recess, the deflection, i.e., the resilient force which presses the edges of the seal band against the surface of the recess does not change provided the curvature of the recess is the same even if the size of the tube varies. Therefore, by using the recess having the same curvature and the same seal band, the same value for the deflection of the seal band can be used for tubes having different sizes. Therefore, once the curvature is optimized with respect to a specific seal band, the combination of the curvature and the seal band always gives an optimum sealing capability even if the size of the tube is different. This eliminates the necessity for calculating the optimum deflection for the respective sizes of the cylinders and largely simplifies steps for designing the seal arrangement.

Further, since a thin metal belt is used for the inner seal band, the thickness of the wall of the tube can be smaller compared to the case where a thick elastomer belt is used for the inner seal band. Therefore, the height of the tube having a non-circular cross section can be largely reduced.

BRIEF DESCRIPTION OF THE DRAWINGS

The present invention will be better understood from the description, as set forth hereinafter, with reference to the accompanying drawings in which.

DESCRIPTION OF THE PREFERRED EMBODIMENT

Figure 1:
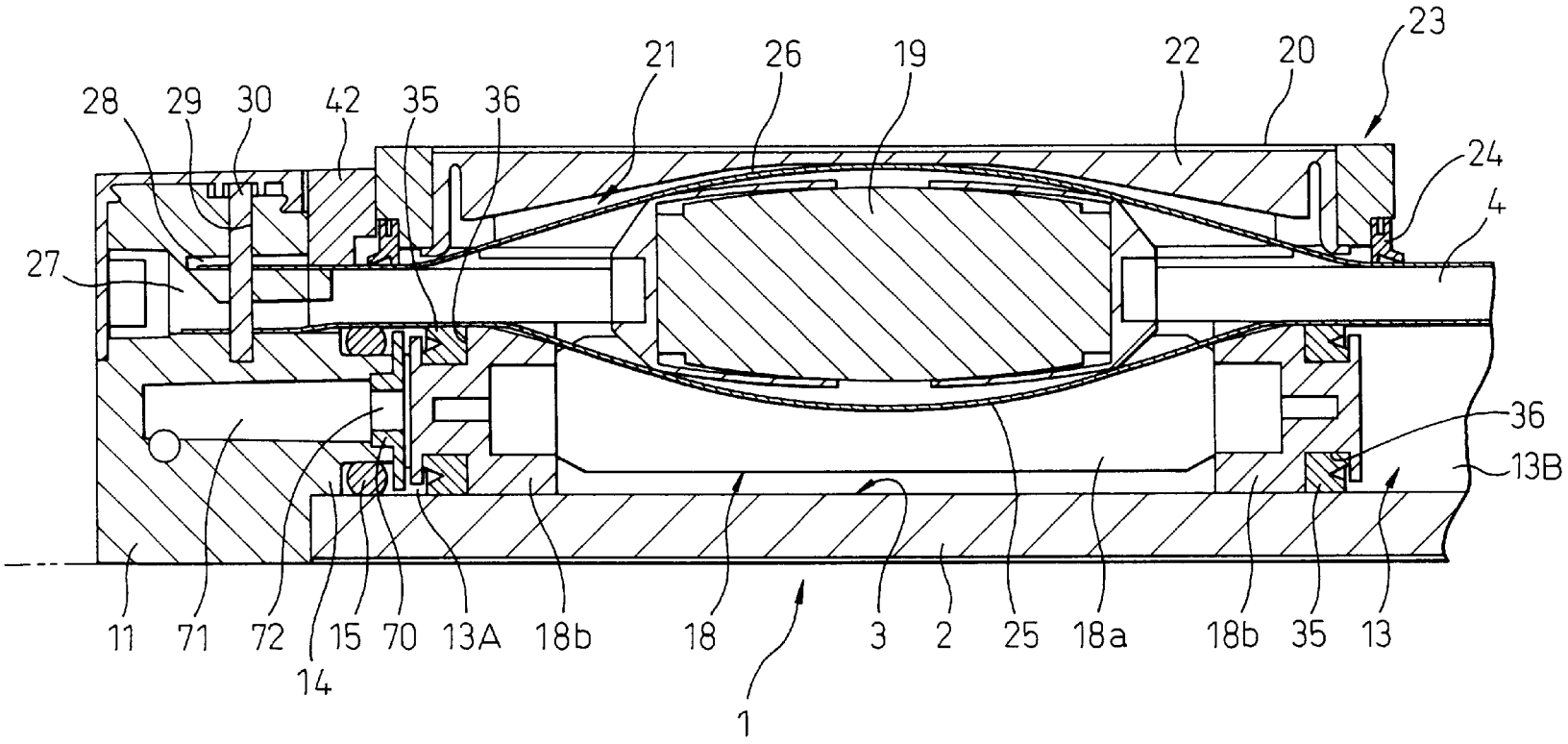
FIG. 1 is a longitudinal section view of a rodless power cylinder according to an embodiment of the present invention.
Figure 2:
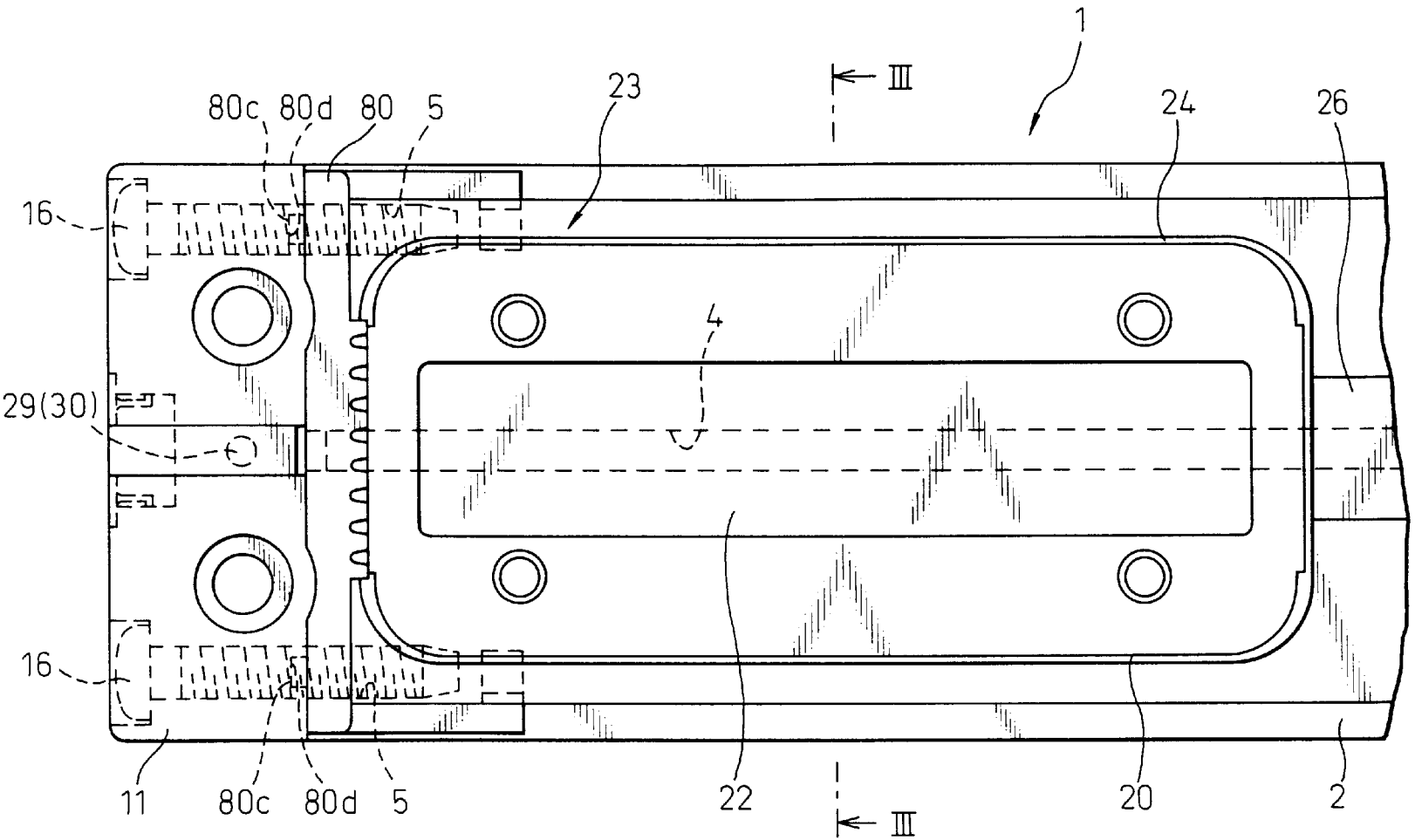
FIG. 2 is a plan view of the rodless power cylinder in FIG. 1.
Figure 3:
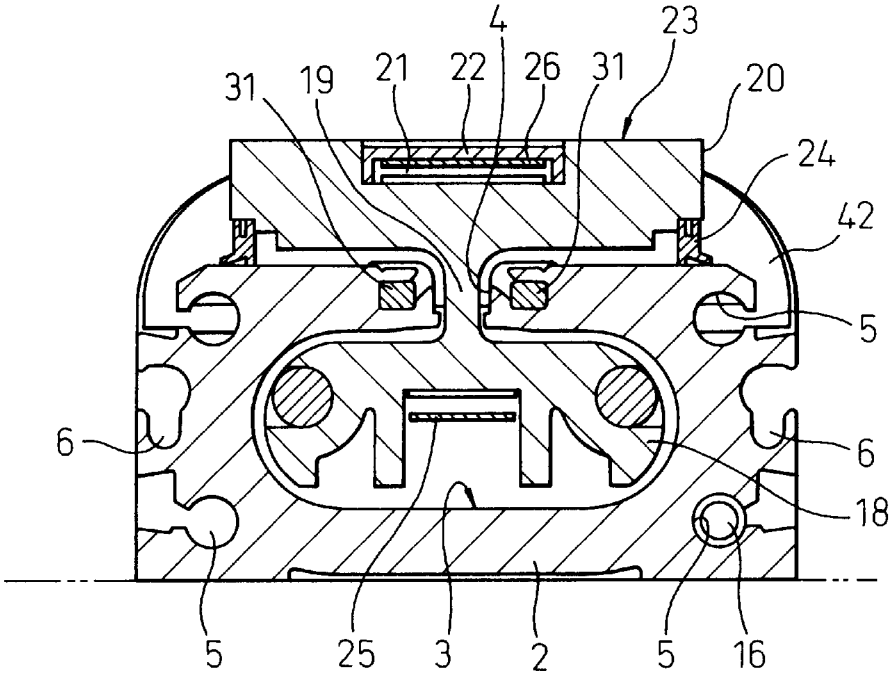
FIG. 3 is a cross section view taken along the line III—III in FIG. 2.
Figure 4:
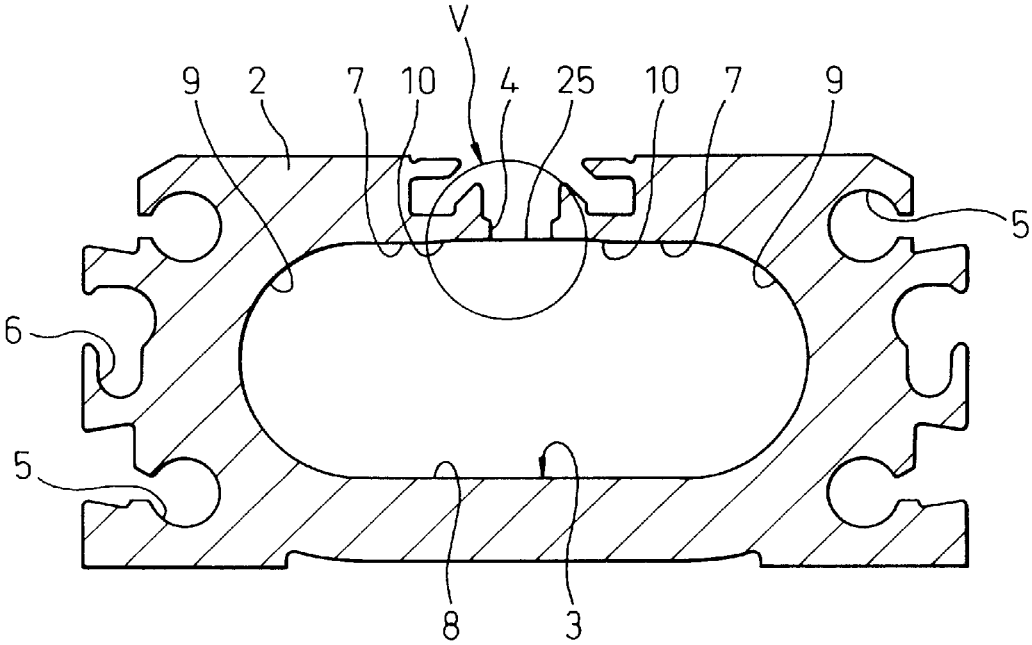
FIG. 4 is a cross section view of the tube in FIG. 1.

Hereinafter, embodiments of the rodless power cylinder according to the present invention will be explained with reference to FIGS. 1 through 20. In FIG. 1, reference numeral 1 designates a rodless power cylinder. Numeral 2 is a tube (cylinder barrel) of the rodless power cylinder 1 which is made of non-magnetic metal such as aluminum alloy and formed by an extrusion or a drawing process. As shown in FIGS. 3 and 4, the cylinder tube 2 has a non-circular (in this embodiment, an oblong circular) bore 3. A slit opening 4 is formed on the side wall of the cylinder tube along the entire length thereof. On the outer wall of the cylinder tube 2, grooves 5 for attaching end members to the tube 2 and grooves 6 for mounting attachments, such as sensors, are formed along the entire length of the cylinder tube 2.

FIG. 4 shows the cross section of the bore 3. Bore 3 has an oblong circular cross section. In this embodiment, the slit-side inner surface 7 of the bore on which the slit 4 opens and the counter-slit-side inner surface 8 of the bore which opposes the slit-side inner surface 7 are formed as flat planes parallel to each other. The slit-side inner surface 7 and the counter-slit-side inner surface 8 are connected by cylindrical surfaces 9.

Figure 5:
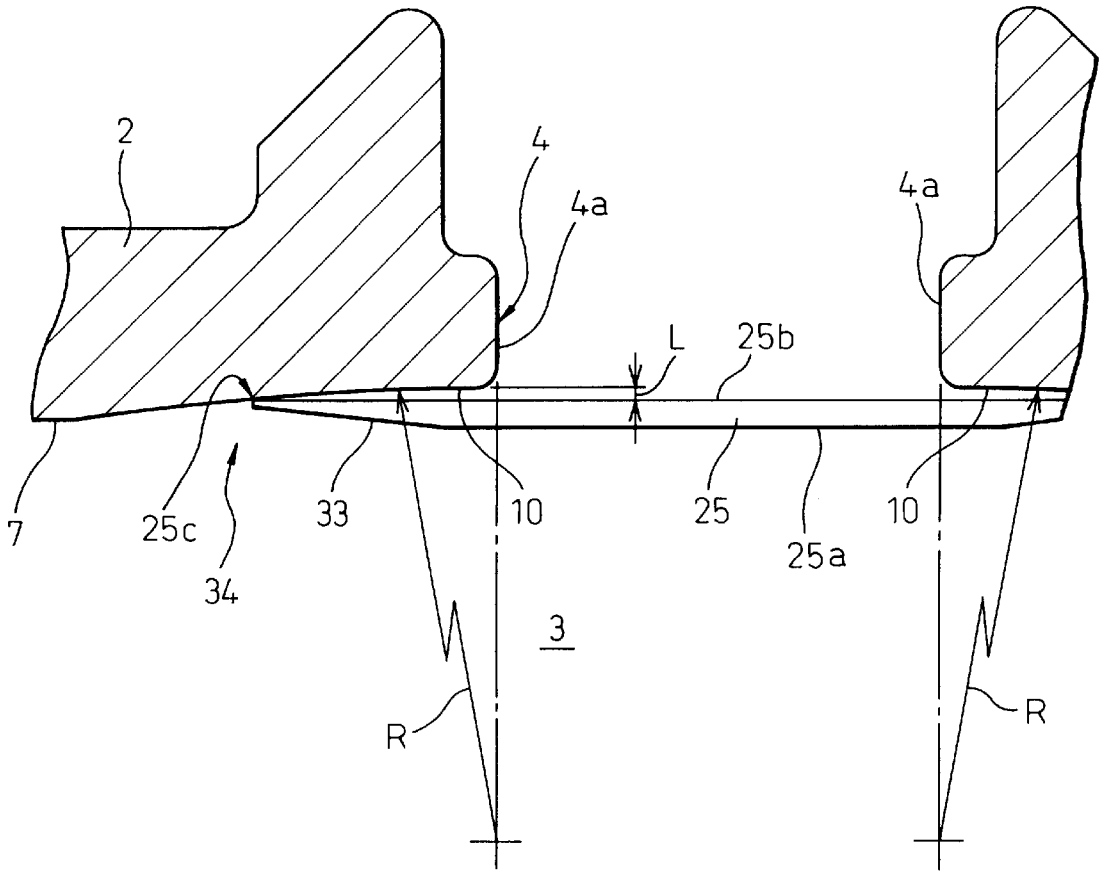
FIG. 5 is an enlarged view of the portion V in FIG. 4.

The portions of the slit-side inner surface 7 on both sides of the slit 4 are formed as cylindrical surfaces 10. FIG. 5 is an enlarged view of the portion V in FIG. 4. As seen from FIG. 5, the center axes of the cylinders which form the cylindrical surfaces 10 lie on the plane extending from the respective walls 4*a* of the slit. Namely, in this embodiment, the slit walls 4*a* are connected to the flat planes of the slit-side inner surface 7 by cylindrical surfaces 10. In this embodiment, the cylindrical surfaces 10 form a recess for receiving an inner seal band 25. Though the slit-side inner surface 7 is formed as a flat plane in this embodiment, the slit-side inner surface 7 may be formed as a curved plane having a very small curvature. When the slit-side inner surface 7 is formed as a curved plane, the curvature of the surfaces of the recess 10 are set larger than the curvature of the slit-side inner surface 7.

Figure 10:
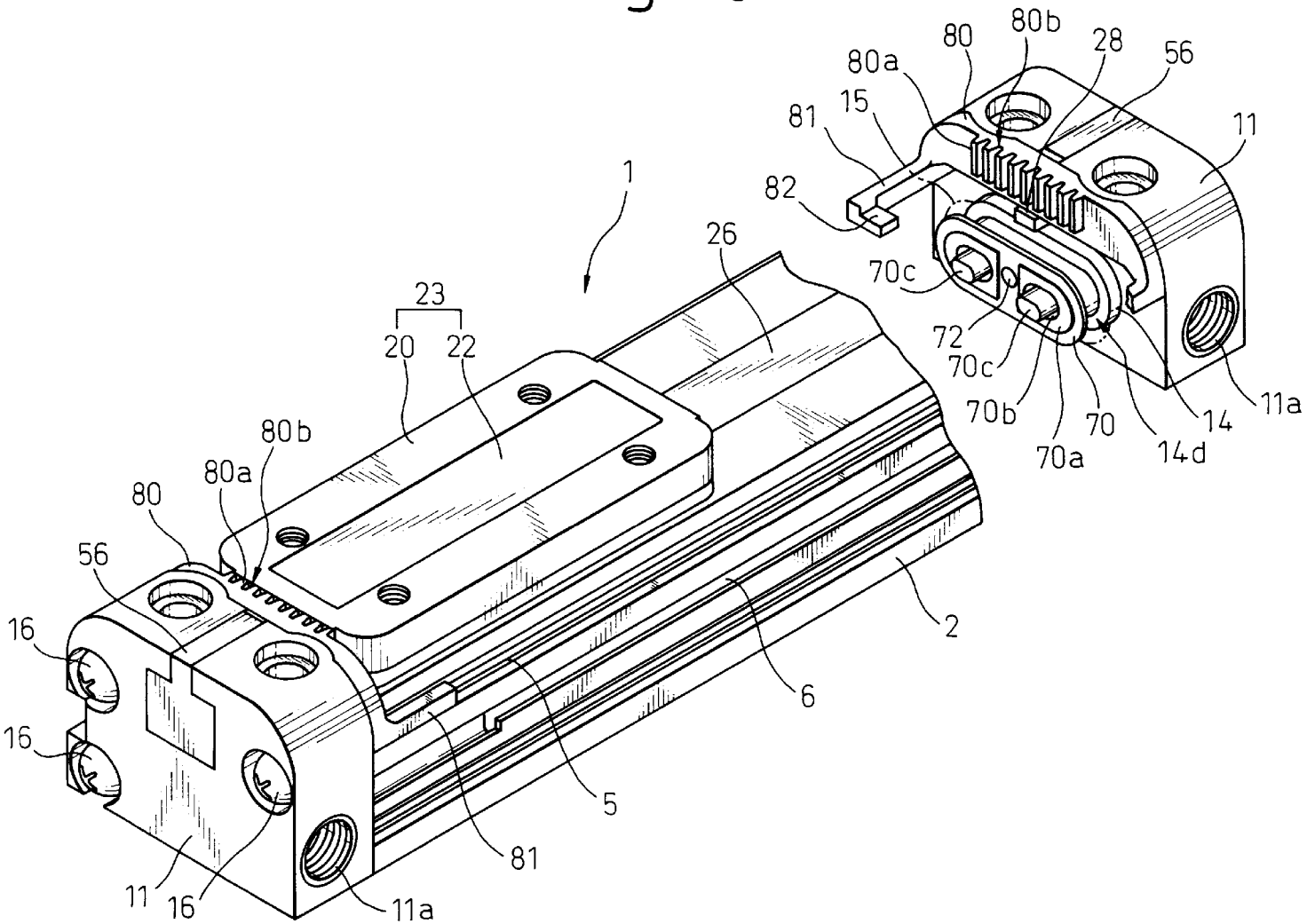
FIG. 10 is a partial cutaway view of the rodless power cylinder in FIG. 1.

Both ends of the cylinder tube 2 are closed by end members 11, and a cylinder chamber 13 is defined by the wall of the bore 3 and end members 11 as shown in FIG. 1. The end member 11 has an insert portion 14 which is inserted into the tube 2 with a cylinder gasket 15 intervening therebetween. In this condition, the end member 11 is secured to the end of the cylinder tube 2 by tightening self-tapping screws 16 into the ends of the grooves 5 (FIG. 2). A self-tapping screw is a screw which cuts a thread in the wall of a screw hole by itself when it is screwed into the screw hole. In this embodiment, the self-tapping screws 16 are manufactured, for example, in accordance with JIS (Japanese Industrial Standard) No. B-1122. However, other self-tapping screws can be used as the screws 16. By using the self-tapping screws 16, since it is not required to cut the threads on the inner wall of the grooves 5 before attaching the end members, the manufacturing process of the cylinder tube 2 is largely simplified. In this embodiment, since an inlet and outlet port 11*a* (FIG. 10) are provided on the side face of the respective end members 11, three screws 16 are used for securing each of the end members 11 (FIG. 10).

The cylinder chamber 13 is divided into a fore cylinder chamber 13A and an aft cylinder chamber 13B by piston ends 18*b* formed on both sides of a piston body 18*a* (FIG. 1). The piston body 18*a* and the piston ends 18*b* form a piston 18. Piston packings 35 are attached to both piston ends 18. On the piston 18, a piston yoke 19 for driving an external moving body 23 through the slit 4 is formed integrally at the portion between the piston ends 18*b* (FIG. 1). At the end of the piston yoke 19 outside of the tube 2, a piston mount 20 which acts as a base of the external moving body 23 is integrally formed. Namely, the piston 18 and the piston yoke 19 and the piston mount 20 form an integral one-piece moving body in this embodiment. This one-piece moving body 18 is formed by die-casting an aluminum alloy. A recess 21 is formed on the upper face of the piston mount 20 at the portion above the piston yoke 19. The recess 21 is extended in the direction along the longitudinal axis of the tube 2. The recess 21 forms a channel groove through which an outer seal band 26 passes.

A scraper 24 is attached to the piston mount 20 around the lower periphery thereof in order to prevent the incursion of dust into the space between the tube 2 and the piston mount 20.

The outer seal band 26 and the inner seal band 25 are disposed between the end members 11 on both ends of the tube 2 along the entire length of the slit 4. The outer seal band 26 passes the upper face of the piston yoke 19, and the inner seal band passes the lower face of the piston yoke 19. The outer and the inner seal bands are thin flexible bands made of, for example, a magnetic metal such as steel. The seal bands 25 and 26 have widths wider than the slit 4. Both ends of the seal bands 25, 26 are fitted to the end members 11 by fitting pins 30 inserted into fitting holes 29. Covers are attached to the end members 11 in order to cover the outer ends of the fitting pins 30 (FIG. 1). The covers prevent the fitting pins 30 from falling out from the end members 11.

In this embodiment, magnets 31 are disposed on both sides of the slit 4 along the entire length thereof. Therefore, the seal bands 25 and 26 are attracted to the magnets 31 along the entire length thereof except the portions thereof passing through the piston yoke 19. The inner seal band 25 adheres to and seals the slit 4 by the pressure of the fluid in the cylinder chamber 13 and the attracting force of the magnets 31. The outer seal band 26 also adheres to and seals the slit 4 by the attaching force of the magnets 31.

As can be seen from FIG. 5, the inner seal band 25 has an outside surface 25*b* which faces the slit opening and an inside surface 25*a* facing the bore 3 of the tube when the inner seal band 25 is installed in the tube. The portions of the inside surface 25 near the transverse edges 25*c* thereof are machined in order to form a slope 33. The edges of the outside surface 25*a* are pressed against the surfaces of the recess 10 by the attraction force of the magnet 31 and the fluid pressure in the bore 3 and form a seal preventing leakage of the fluid through the slit 4. The edges 25*c* of the outside surface 25*b* are machined accurately, for example, using a shaper to ensure that no deformation or distortion of the edges 25*c* exist. In this embodiment, the thickness of the edges is set at a value less than 0.1 mm and is preferably set at about 0.02 to 0.05 mm. As seen from FIG. 5, when the seal band 25 is flat (i.e., when the seal band 25 does not deflect toward the slit), the inside surface 25*a* of the seal band lies flush with the slit-side inner surface 7, i.e., the surface 25*a* and the slit-side inner surface 7 lies on a same plane. Therefore, at the edges 25*c* of the seal band, cavities 34 are formed by the surfaces of the recess 10 and the slope 33 of the inside surface 25*a* of the seal band 25. The distance L between the opening of the slit 4 and the outside surface 25*b* of the seal band 25 (FIG. 5), i.e., the amount of deflection L of the seal band 25 when the fluid pressure is exerted is set at an optimum value in such a manner that the resilient force caused by the deflection of the seal band which presses the edges 25*c* to the surface of the recess 10 becomes an appropriate value. This optimum deflection (i.e., the resilient force) is a deflection where the leakage of the fluid through the contact portion between the edges 25*c* and the surface of the recess 10 is reduced to a practically acceptable level, and is determined by experiment.

Since the optimum deflection is determined by the curvature of the surface of the recess 10 and the property of the seal band 25, if the combination of the same seal band 25 and the same curvature of the surface of the recess 10 is used, the same sealing capability is obtained even if the sizes of the tube is different. Therefore, it is not necessary to set the optimum deflection L and the curvature of the surface of the recess 10 for respective tube sizes. In this embodiment, an optimum sealing capability was obtained, for example, when the radius of the curvature of the surface of the recess 10 is set at 25 mm and the deflection L is set at 0.125 mm.

Figure 12:
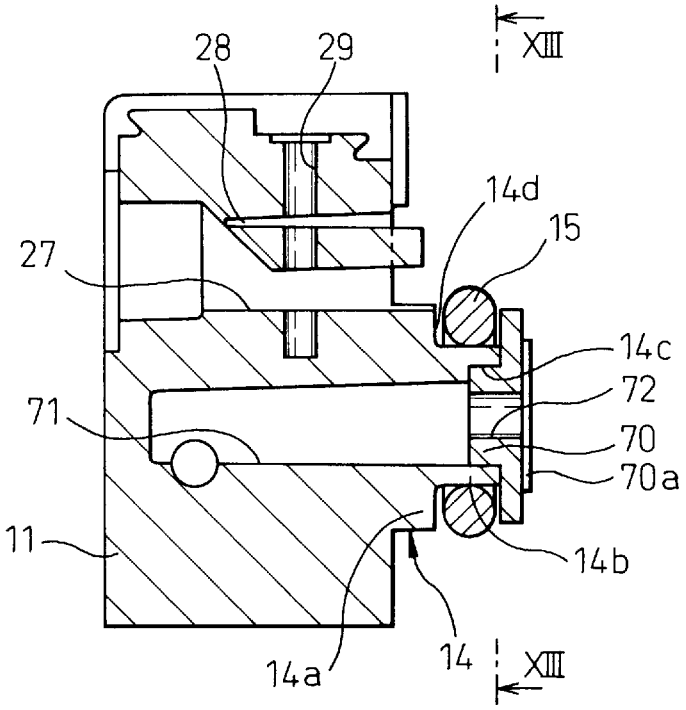
FIG. 12 is a longitudinal section view showing the insert portion of the end member.

Next, the dampers in this embodiment will be explained. As best shown in FIG. 10, internal dampers made of rubber are attached to the insert portions 14 of the respective end members 11. The internal dampers 70 abut the piston ends 18*b* at the stroke ends of the piston 18. As shown in FIG. 12, the internal damper 70 is attached to the end of the insert portion 14, for example, by an adhesive. When the damper 70 is attached to the insert portion 14, a gasket groove 14*d* which holds the cylinder gasket 15 is formed between the end member 11 and the internal damper 70. An inlet/outlet port 72 is disposed at the center of the internal damper 70. The working fluid is supplied to and drained from the cylinder chamber 13 via the inlet/outlet port 11*a* and a fluid passage 71 in the end member 11 and the inlet/outlet port 72 on the internal damper 70. As shown in FIG. 10, a pair of fitting holes 70*b* are formed on the end face 70*a* of the damper 70, and rod-like elastomer damper members 70*c* are inserted into the respective fitting holes 70*b*. When the damper member 70*c* is fitted to the damper 70, the damper member 70*c* protrudes from the end face 70*a* by a predetermined amount. The size of the fitting holes 70*b* is larger than the cross section of the damper member 70*c*. The size of the fitting hole 70*b* is determined in such a manner that the maximum lateral deflection and/or the maximum expansion of the diameter of the damper member 70*c* when the damper member 70*c* is compressed by the piston end 18*b* at the stroke end can be allowed within the fitting hole 70*b*. The damper member is made of a material having a relatively low elastic modulus such as a nitrile rubber so that the damper member 70*c* easily deflects in the axial direction.

Further, each of the end members 11 is provided with an external elastomer damper 80 which abuts the longitudinal ends of the external moving body 23 when the external moving body 23 reaches its stroke end. A plurality of vertical grooves 80*b* are formed on the face of the external damper 80 facing the external moving body 23 (FIGS. 2 and 10) so that the portion of the damper 80 abutting the external moving body 80 easily deflects. Protruding portions 80*c* are provided on the backside of the damper 80. These protruding portions 80*c* are inserted into corresponding recesses 80*d* when the damper 80 is attached to the end member 11 in order to position the damper 80.

Figure 11:
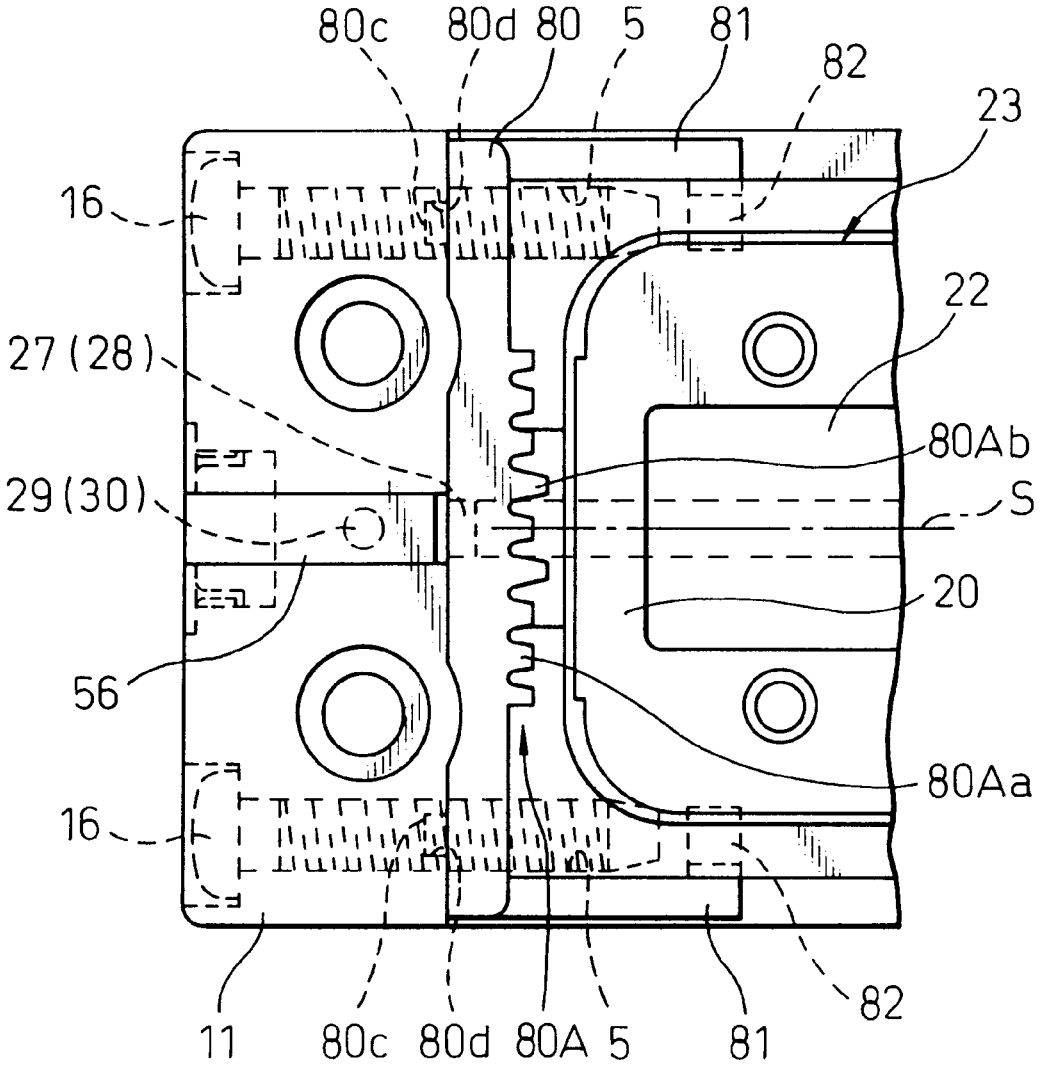
FIG. 11 is a partial plan view showing an embodiment of the external damper.

Further, as seen from FIGS. 2 and 11, the external damper 80 is provided with lower end portions 81 extending along the grooves 5 of the cylinder tube 2. An insert member 82 is provided on each of the ends of the extended lower end portions 81 as shown in FIG. 10. The length of the lower end portions 81 are determined in such a manner that the insert members 82 are located inside the ends of the self-tapping screws 16 when the dampers 80 contacts the end member 11. The dampers 80 are attached to the tube 2 by inserting the insert members 82 into the grooves 5 at the position inside the tips of the self-tapping screws 16. Therefore, two self-tapping screws 16 on both sides of the tube 2 are covered by the lower end portions 81 of the dampers 80. This fitting arrangement allows an easy fitting/removal of the external damper 80.

When the piston 18 moves to its stroke end, the rod-like elastomer damper member 70*c* first contacts the piston end 18*b*. The damper member 70*c* deflects in the axial direction as the piston 18 further proceeds, i.e., the damper member 70*c* is compressed and expands in the radial direction. A part of the kinetic energy of the piston 18 is absorbed by this deflection of the damper member 70*c*. Since the damper member 70*c* is formed as a rod-like shape, the deflection thereof in the axial direction becomes relatively large. Further, since the cross section of the fitting hole 70*b* is larger than the cross section of the damper member, a relatively large clearance is formed between the periphery of the damper member 70*c* and the wall of the fitting hole 70*b*. The damper member 70*c* is allowed to deflect in the axial direction until the periphery of the damper member 70*c* contacts the wall of the fitting hole 70*b* due to the expansion of the diameter thereof. Since the axial deflection of the damper member 70*c* is large, the distance that the piston 18 travels before the piston end 18 hits the end face 70*a* after it contacts the damper member 70*c* becomes also large. Therefore, the deceleration of the piston 18 after it contacts the damper member 70*c* is relatively small and, thereby, the piston 18 stops smoothly. When the periphery of the damper member 70*c* contacts the inner wall of the fitting hole 70*b*, the rigidity of the damper member increases since the damper member cannot deflect any more. At this moment, the piston end 18 abuts the end face 70*a* of the internal damper 70 and stops completely.

Around the timing when the piston end 18*b* hits the end face 70*a* of the internal damper 70, the external moving body 23 contacts the external damper 80 in order to absorb the remaining kinetic energy of the piston 18 and the external moving body 23. Since the external damper 80 abuts the external moving body 23, the bending moment exerted on the yoke 19 when the piston 18 stops becomes very small. Further, the kinetic energy of the piston 18 and the external moving body 23 are absorbed by both of the internal damper 70 and the external damper 80, the sound generated when the external moving body 23 hits the external damper 80 also becomes very small.

FIG. 11 shows another embodiment of the external damper 80. In this embodiment, a first group of protrusions 80A*a* and a second group of protrusions 80A*b* which has an amount of protrusion smaller than the first group of protrusions 80A*a* are formed on the end face 80A of the external damper 80. In this embodiment, the external moving body 23 first hits the first group of protrusions 80A*a*. Therefore, a part of the kinetic energy of the external moving body 23 is consumed for deflecting the first group of the protrusions 80A*a*. The external moving body 23 hits the second group of the protrusions 80A*b* after it deflects the first group of the protrusions 80A*a*. Thus, the remaining kinetic energy of the external moving body 23 is completely absorbed by deflecting the second group of the protrusions 80A*b*. Therefore, in this embodiment, a so-called two-stage cushioning braking, in which the kinetic energy of the external moving body 23 is absorbed in two-stage is performed. This makes the external moving body stop smoothly without rebounding. Therefore, according to this embodiment, the position of the external moving body when it stops at its stroke end can be precisely controlled.

Next, the cylinder gasket 15 in this embodiment will be explained with reference to FIGS. 12 and 13.

Figure 13:
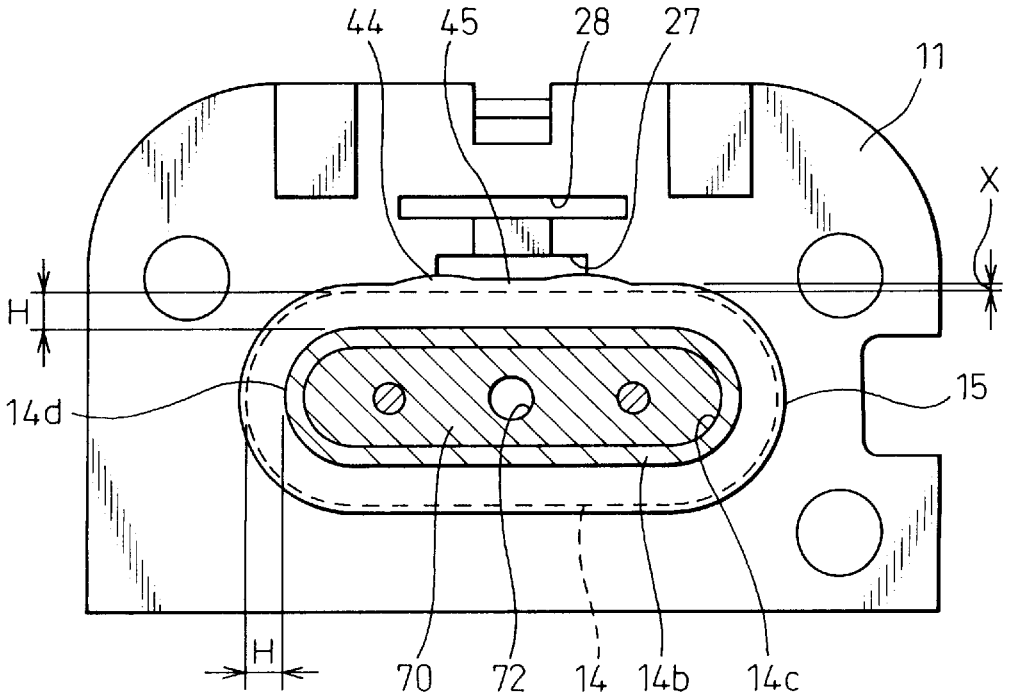
FIG. 13 is a section view taken along the line XIII—XIII in FIG. 12.

As shown in FIGS. 12 and 13, the insert portion 14 of the end member 11 has an oblong circular cross section which matches the cross section of the bore 3. The insert portion 14 is provided with a larger diameter portion 14*a* which fits the bore 3 and a smaller diameter portion 14*b* formed at the end of the insert portion 14. On the end face of the smaller diameter portion 14*b*, a recess 14*c* is formed. The internal damper 70 is provided with a protrusion which fits the recess 14*c* to position the damper 70 when it is attached to the end member 11. When the internal damper 70 is attached to the end face of the smaller diameter portion 14*b*, an annular groove 14*d* for receiving the cylinder gasket 15 is formed by the damper 70 and the larger diameter portion 14*a* as is seen from FIG. 12. The bottom of the groove 14*d*, i.e., the periphery of the smaller diameter portion 14*b* is formed as a flat surface having no bulging portion. The depth H of the groove is selected in such a manner that the leak of the fluid does not occur between the cylinder gasket 15 and the bore inner surface and, in this embodiment, the depth H is set at a relatively large value. Since the depth H is set at a relatively large value, the height of the cylinder gasket protruding from the groove when it is fitted in the groove 14*d* becomes a relatively small in this embodiment.

The cylinder gasket 15 is also formed as an oblong annular shape having the inner diameter of the annulus smaller than the outer diameter of the smaller diameter portion 14*b* of the insert portion 14. Therefore, when the gasket 15 is fitted to the groove 14, the deformation of the gasket 15 does not occur. This allows smooth insertion of the insert portion 14 into the bore 3. A pair of bulging portions 44 are formed on the outer periphery of the cylinder gasket 15 at the portions contacting the edge portions 25*c* of the inner seal band 25. When the end member 11 is inserted into the bore 3, these bulging portions 44 fill the cavity 34 formed by the recess 10 and the edges 25*c* of the inner seal band 25. The outer periphery of the cylinder gasket 15 at the portion between the bulging portion 44 and contacting the inside surface 25*a* is formed as a thick portion where the thickness (height) of the chord of the cylinder gasket is larger than the other portions of the cylinder gasket contacting the inner surface of the bore 3. However, the thickness of the thick portion 45 is smaller than the thickness at the bulging portion 44. The thicknesses of the thick portion 45 and the bulging portions 44 are determined in such a manner that the amounts of the protrusion of these portions from the gasket groove 14*d* are sufficient for obtaining optimum contacts between the inner seal band 25 and these portions in order to prevent the leakage of the fluid from these portions.

Heretofore, it has been difficult to completely prevent the leakage through the cavity 34 where the contact pressure between the cylinder gasket and the surfaces of the recess and the inner seal band become small. However, in this embodiment, since the bulging portion 44 enters the cavity 34 and fills the entire volume thereof, a large contact pressure between the cylinder gasket 15 and surfaces of the recess 10 and the inner seal band, which is sufficient for preventing the leakage through the cavity, can be obtained. Further, the thick portion 45 is formed on the cylinder gasket 15 where it contacts the inside surface 25*a* of the inner seal band 25 in this embodiment. Therefore, the contact pressure between the cylinder gasket and the surface 25*a* is also high and a good sealing capability can be obtained at this portion. It is true that the compression of the cylinder gasket 15 becomes large at these portions. However, since the thickness of the chord of the cylinder gasket is large at these portions, the permanent deformation of the cylinder gasket is kept small at theses portions. Thus, a stable sealing capabilities can be obtained at these portions.

In order to form the bulging portions 44 and the thick portion 45 on the cylinder gasket 15, a special die for producing the cylinder gasket 15 is required in this embodiment. However, even though the special die is required, the cost of the special die is much lower than the cost of the special die required for forming the bulging portion on the groove bottom of the end member such as used in the related art.

Figure 6:
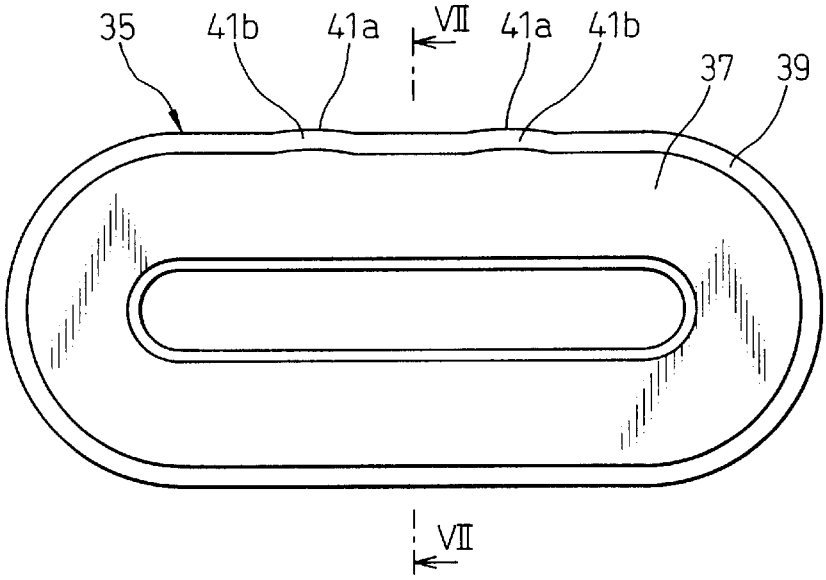
FIG. 6 is a front view of the piston packing.
Figure 7:
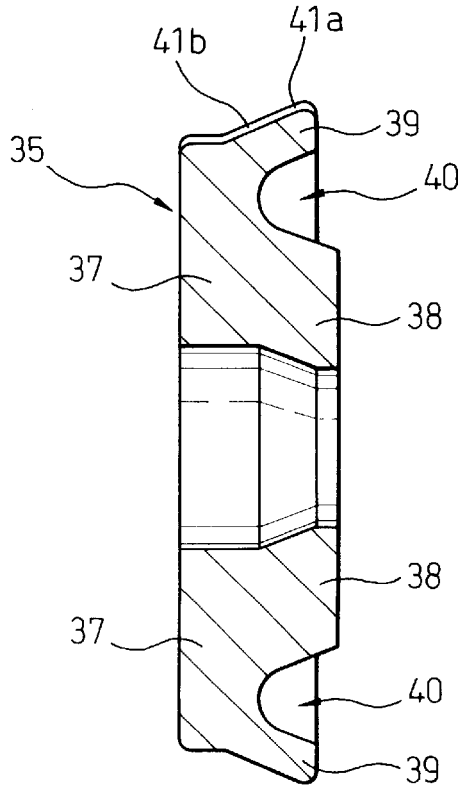
FIG. 7 is a sectional view taken along the line VII—VII in FIG. 6.
Figure 8:
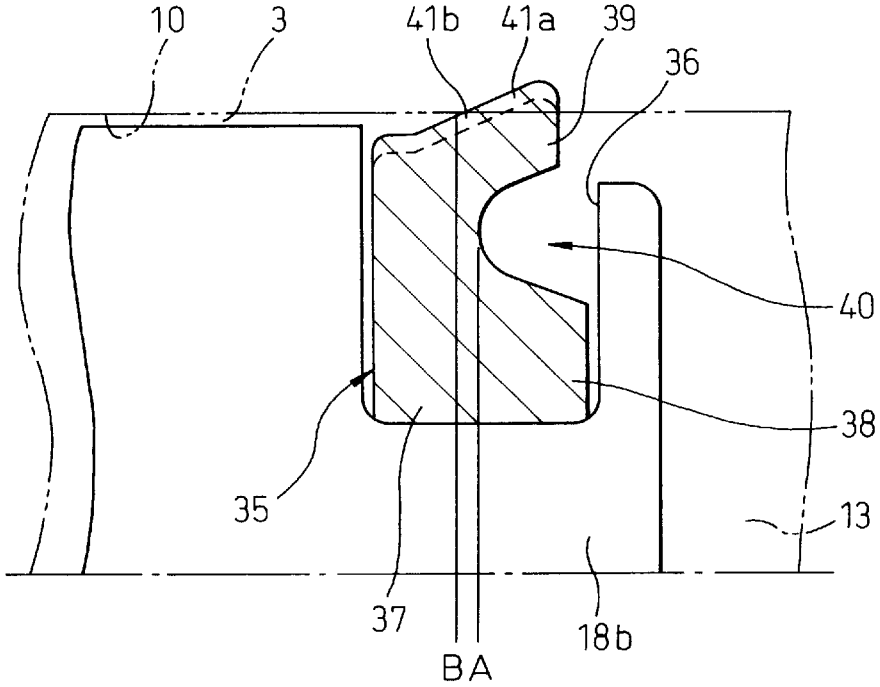
FIG. 8 is a sectional view showing the piston packing when it is attached to the piston end.
Figure 9:
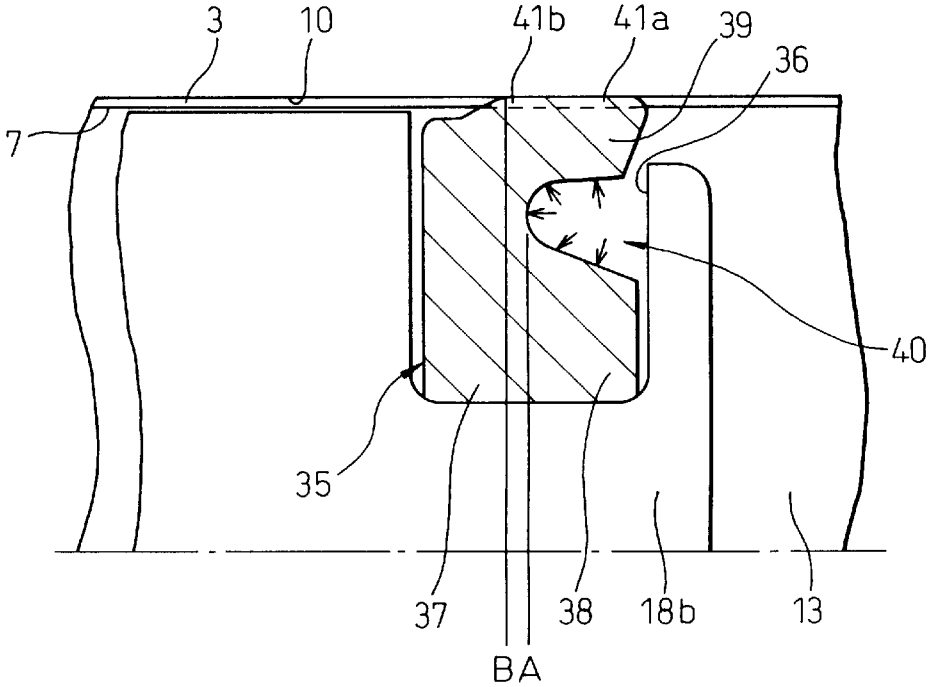
FIG. 9 is a section view similar to FIG. 8, showing the piston packing when it is inserted into the bore of the tube.

Next, the piston packing 35 in this embodiment will be explained with reference to FIGS. 6 through 9. FIGS. 8 and 9 show the piston packing 35 when it is attached to the piston end 18*b*. As can be seen from FIGS. 8 and 9, the piston packing 35 is fitted to an annular packing groove 36 formed on the piston end 18*b*. FIGS. 6 and 7 show the shape of the piston packing 35 in this embodiment. The outer shape of the piston packing 35 is an oblong circle similar to the cross section of the bore 3. However, the cross section of the piston packing 35 is larger than the cross section of the bore 2. FIG. 7 is a sectional view taken long the line VII—VII in FIG. 6. As shown in FIG. 7, the piston packing 35 consists of a base portion 37, an inner lip 38 and an outer lip 39. A recess 40 is formed between the inner lip 38 and the outer lip 39. A center hole penetrating the base portion 37 and the inner lip 38 is formed on the piston packing 35. The piston end 18*b* is inserted to this center hole in order to fit the piston packing 35 in the groove 36 (FIGS. 8 and 9). When the piston packing 35 is fitted on the piston end, the outer lip 39 is pressed against the inner wall of the bore 3 and the inside surface 25*a* of the inner seal band 25. As can be seen from FIGS. 6 and 7, bulging portions 41*a* are formed on the outer periphery of the outer lip 39 at the position corresponding to the cavity 34 formed by the recesses 10 of the slit-side inner surface 7 and the edges 25*c* of the inner seal band 25. The shape of the bulging portion 41*a* matches the shape of the cavity 34 so that the bulging portion 41*a* fills the cavity 34 when the piston packing 35 is fitted on the piston end 18*b*. At the bulging portions 41*a*, the outer periphery of the base portion 37 on the back side of the outer lip 39 swells to increase the thickness (height) of the chord of the piston packing 35. This swelled portion 41*b* continues to the bulging portion 41*a*. The position of the swelled portions 41*b* in the direction of the longitudinal axis of the tube is on the piston body 18*a* side compared to the bottom A of the recess 40 (FIGS. 8 and 9). The piston packing 35 is formed from elastomer and has a hardness similar to that of a general packing such as about HS (Shore hardness) 70. The surface of the piston packing 35 may be treated by, for example, a chlorinating treatment in order to increase lubricating capability of the packing surface. Alternatively, the hardness of the piston packing 35 may be relatively lower (for example, around HS 60) in order to increase the sealing capability. In this case, the surface of the packing 35 may be treated by, for example, a chlorinating treatment to compensate for a low durability caused by the lower hardness.

When the fluid pressure is exerted on the outer lip 39, the bulging portion 41*a* which fills the cavity 34 is pressed against the wall of the recess 10 and the inside surface of the inner seal band 25 by the fluid pressure. In FIG. 8, the point B indicates the portion where the swelled portion 41*b* starts to contact the wall of the recess 10 of the slit-side inner surface 7 and the inside surface 25*a* of the inner seal band. As can be seen from FIG. 8, the portion of the outer lip 39 between the bottom of the recess 40 and the point B has a thickness (height) larger than other portions of the base portion 37. Therefore, the portion of the outer periphery of the outer lip 39 between the points B and the bottom A of the recess 40 is pressed against the inner seal band 25 with a higher contact pressure due to the compression of the swelled portion 41*b*. Thus, the edge portions 25*c* of the inner seal band 25 is sealed by the bulging portion 41*a* and the swelled portion 41*b* which are pressed against the inner seal band 25 by the fluid pressure exerted on the outer lip 39 and the resilient force generated by the compression of the bulging portion 41*a* and the swelling portion 41*b*.

The portions of the inner seal band 25 that does not contact the piston packing 35 deflects toward the slit 4, and the edges 25*c* of the inner seal band 25 is pressed against the surface of the wall of the recess 10 by the resilient force caused by the deflection of the inner seal band 25 as well as by the fluid pressure exerted on the inner seal band 25. The contact between the edges 25*c* and the surface of the wall of the recess 10 prevents the leakage of the fluid. When the piston 18 moves in the tube 2, the piston packing 35 deforms so that it follows the deflection of the inner seal band 25. Thus, the cylinder chamber 13 is sealed by the inner seal band 25 and the piston packing 35. Since the inner seal band 25 seals the slit 4 by the contact between the edges 25*c* with the wall surfaces of the recesses 10, only the portions of the surfaces of the recesses which contact the edges 25*c* are machined with a higher accuracy to decrease the surface roughness. Therefore, compared to the related art, which requires a very smooth finish of the whole area of the slit-side inner surface which contacts the outside surface 25*b* of the inner seal band, the tube 2 can be manufactured easily.

Further, in this embodiment, when the fluid pressure is higher, the force pressing the outer lip 39 against the surface of the bore 3 and cavities 34 and the inner seal band 25 becomes larger. Therefore, according to the piston packing 35 of the present embodiment, a higher sealing capability can be obtained even when the fluid pressure is high. When the fluid pressure is low, the force pressing the piston packing 35 to the wall surface of the bore 3 also becomes low. However, since the swelled portions 41*b* are formed on the piston packing 35 at the portion where the packing 35 contacts the inner seal band 25, the swelled portion 41*b* is pressed to the inner seal band 25 by the resilient force generated by the compression thereof. Therefore, a good sealing capability is also maintained even when the fluid pressure is low. Further, since the recess 40 is provided between the inner lip 38 and the outer lip 39, the outer lip 39 can easily deflects towards the center of the bore 3 at the portions other than the swelled portion 41*b*, the force pressing the outer lip 39 to the wall of the bore 3 is smaller than the force pressing the swelled portion 41*b* and the bulging portion 41*a* to the seal band, the friction between the piston end 18*b* and the bore wall becomes relatively low as a whole. This allows a smooth movement of the piston 18.

Figure 14:
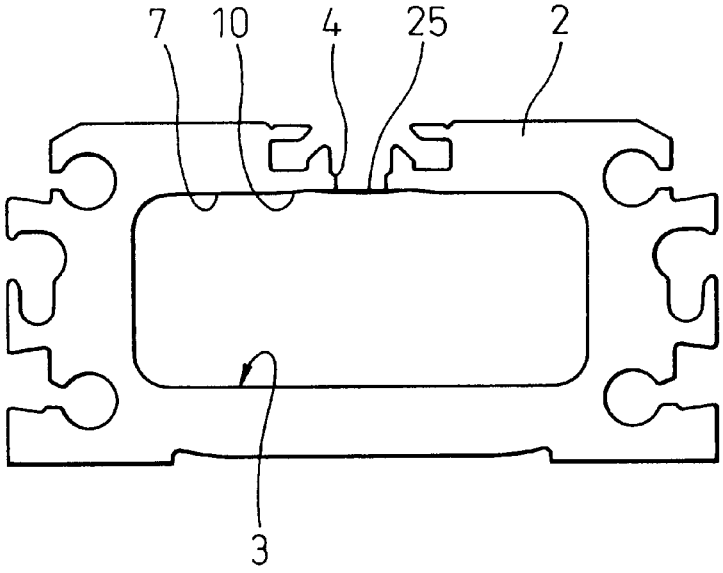
FIGS. 14 through 16 are cross section views of the tube showing various examples of the shape of the bore.
Figure 15:
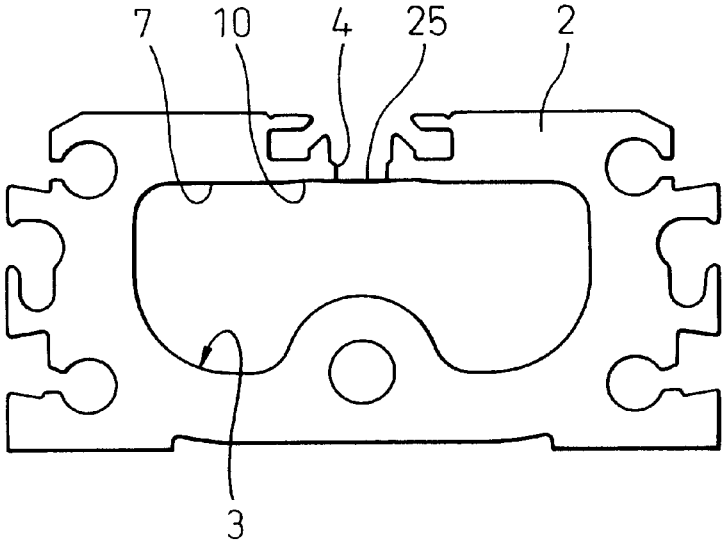
Figure 16:
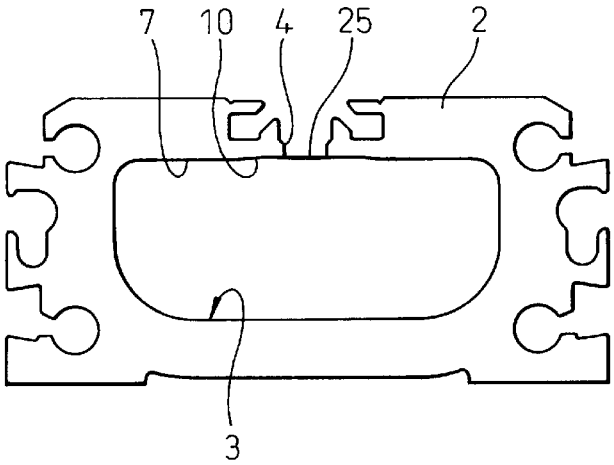
Figure 17:
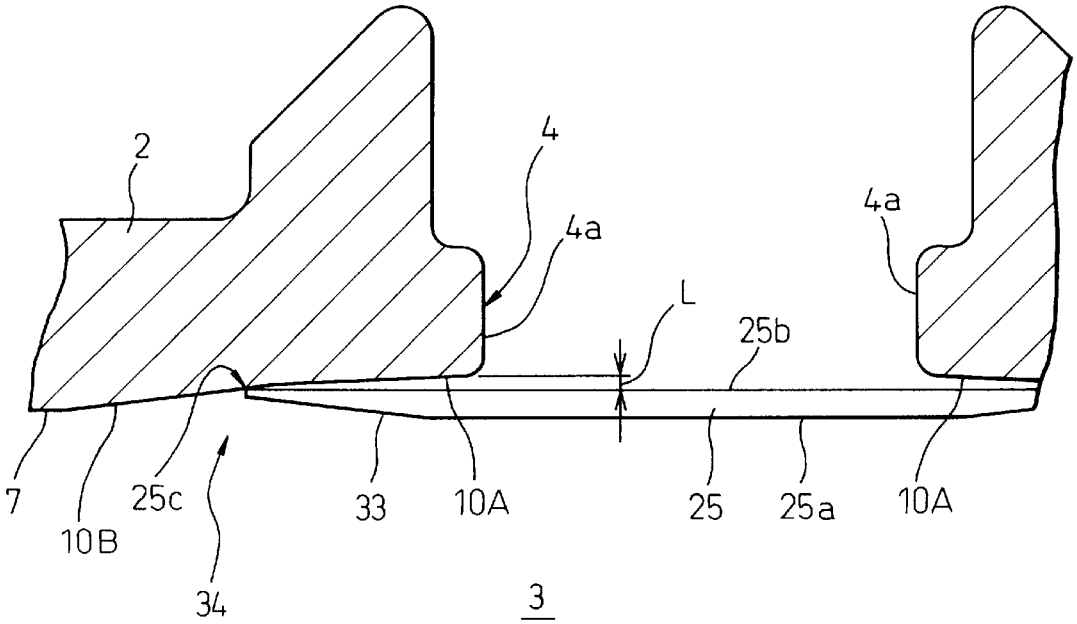
FIG. 17 shows another example of the shape of the recess on the slit-side inner surface of the tube.

FIGS. 14 through 16 show other examples of the shape of the cross section of the bore 3 of the tube 2. As can be seen from FIGS. 14 through 16, the surfaces other than the slit-side inner surface 7 can be any shapes as long as the slit-side inner surface 7 is a flat plane or a curved plane having a very small curvature and the surfaces of the recesses 10 on both sides of the slit 4 has a curvature larger than the curvature of the slit-side inner surface 7. Further, as shown in FIG. 17, the surface of the recesses 10 is not necessarily a curved plane. In FIG. 17, the surfaces of the recess 10 are formed by flat planes having a small inclination with respect to the slit-side inner surface 7. In this case, the inner surface 25*a* of the inner seal band 25 also lies flush with the slit-side inner surface 7, and the distance L between the outer surface 25*b* of the inner seal band 25, i.e., the deflection of the inner seal band 25 is set at an optimum value.

Figure 18:
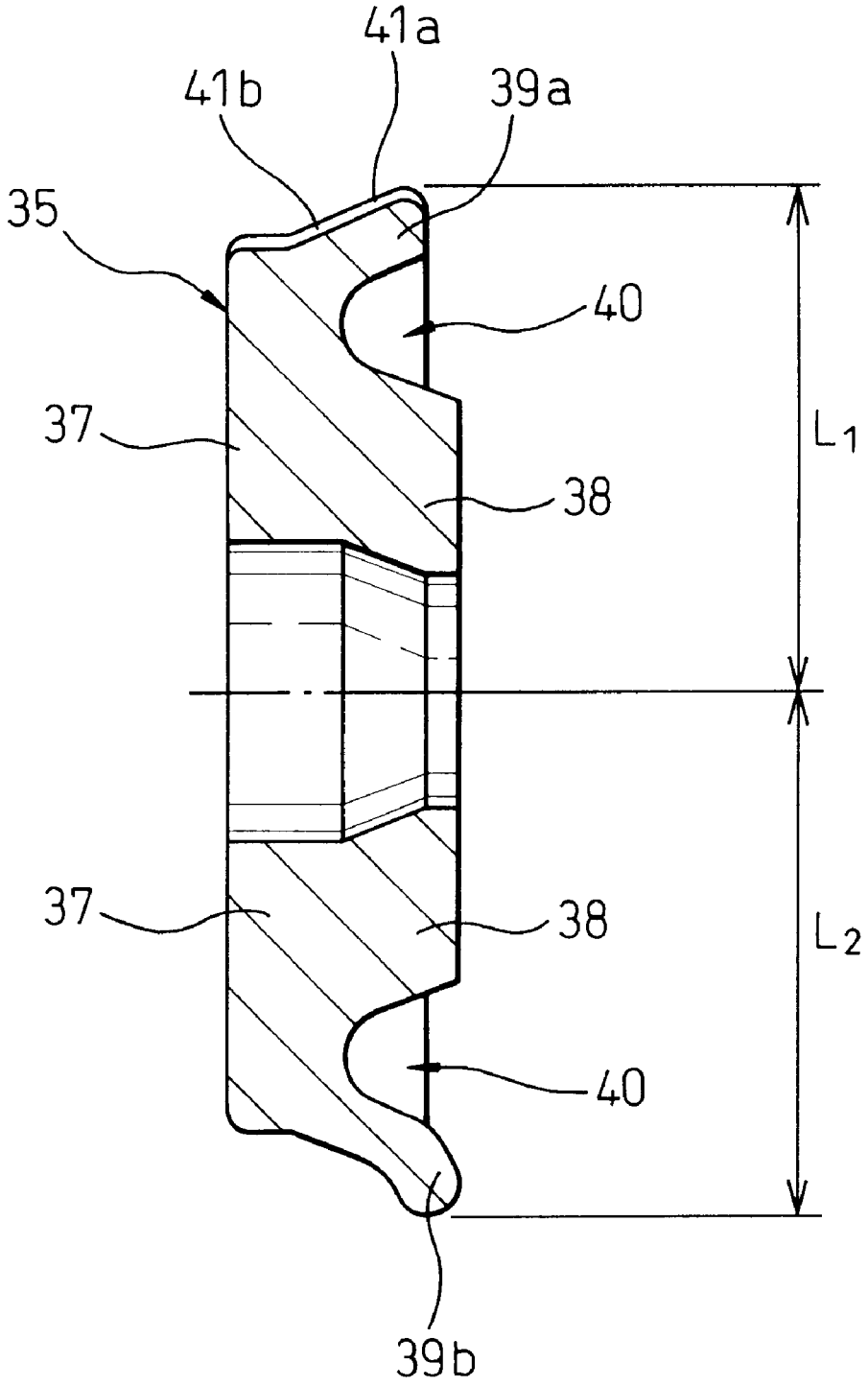
FIG. 18 shows another example of the piston packing.

FIG. 18 shows another embodiment of the piston packing 35. In this embodiment, the outer diameter $L_2$ of the outer lip 39 is larger at the portion 39*b* where it contacts the counter-slit-side inner surface 8 that the outer diameter $L_1$ of the outer lip at the portion 39*a* where it contacts the slit-side inner surface 7. By this arrangement, even if the force pressing the portion 39*b* of the outer lip against the counter-slid-side inner surface 8 becomes small due to a manufacturing tolerance of the tube 2, a high sealing capability between the portion 39*b* and the counter slit-side inner surface can be maintained.

Figure 19:
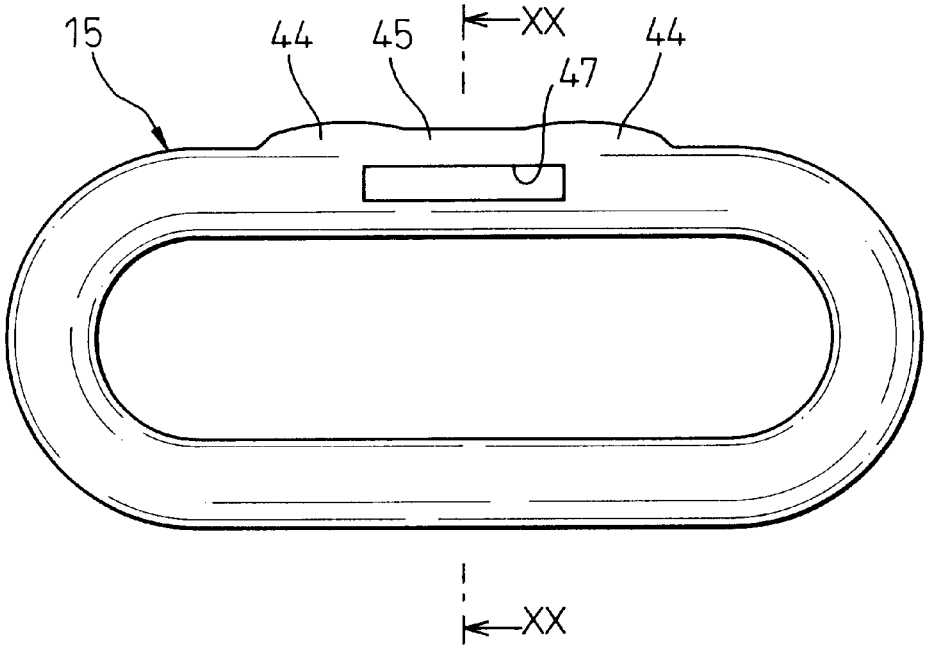
FIG. 19 shows another example of the cylinder gasket.
Figure 20:
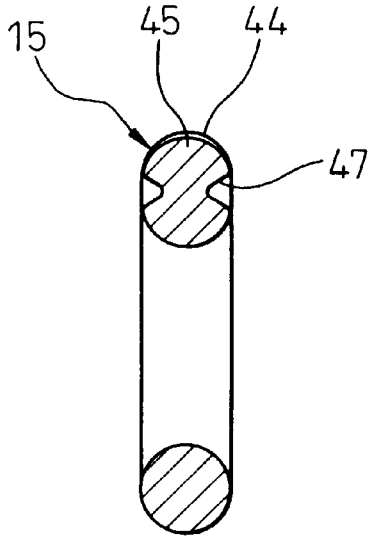
FIG. 20 is a section view taken along the line XX—XX in FIG. 19.

FIGS. 19 and 20 show another embodiment of the cylinder gasket 15. The cylinder gasket in this embodiment is formed as an annular oblong shape. The portion of the outer periphery of the cylinder gasket 15 corresponding to the cavities 34 of the slit-side inner surface 7 is formed as bulged portions 44 and the portion between the bulging portions 44 is formed as a thick portion 45. On both sides of the chord of the gasket 15 at the thick portion 45, notches 47 are formed in this embodiment. Since the notches 47 are formed on the chord of the gasket 15, the force pressing the thick portion 45 to the inner seal band 25 can be adjusted by setting the size of the notches at an appropriate value. By forming the notches 47, the chord diameter of the gasket 15 can be increased in order to reduce the permanent deformation of the gasket 15 due to the compression thereof, while keeping the contact pressure between the thick portion 45 and the inner seal band 25 at an appropriate value.

When the notches 47 are provided, the bulging portions 44 may be omitted. In this case, since the notches 47 are formed on both sides of the chord of the thick portion 45 which contacts the inside face 25*a* of the inner seal band 25, the parts of the thick portions 45 at both ends of the notches 47, i.e., the parts of the thick portion 45 corresponding to the cavities 34, are pressed against the edges 25*c* of the inner seal band 25 with a resilient force higher than the resilient force exerted on the parts of the thick portion 45 where the notches 47 are provided. Therefore, the cavities 34 are filled with both ends of the thick portions 45 of the cylinder gasket 15 while the middle portion of the thick portion 45 easily deforms following the deflection of the seal band 25. Thus, in this case, a good sealing capability can be obtained without forming the bulging portions 44 on the cylinder gasket 15.

What is claimed is:

1. A rodless power cylinder comprising:

a tube provided with a bore and a slit which penetrates the wall of the tube and extends in parallel to the longitudinal axis of the tube, said bore having a non-circular cross section and including a slit-side inner surface on which the slit is formed and a counter-slit-side inner surface opposing the slit-side surface;

a piston having a non-circular cross section and disposed in the bore of the tube and movable therein along the direction of the longitudinal axis of the tube, said piston being provided with piston packings at both ends thereof;

an external moving body disposed outside of the tube and coupled to the piston through the slit so that the external moving body moves with the piston along said slit;

an inner seal band extending along the slit and covering the slit from the inside of the bore, said inner seal band being made of thin flexible material and having a flat outer surface between transverse edges thereof;

wherein, the slit-side inner surface of the bore on the plane perpendicular to the longitudinal axis of the tube has substantially no curvature and the portion on the slit-side inner surface on both sides of the slit are formed as a recess for contacting the transverse edges of the inner seal band and wherein the inner surfaces of the recess on both sides of the slit have a curvature larger than the curvature of the slit-side inner surface so that a clearance is formed between the flat outer surface of said inner seal band and the opening of the slit on the slit-side inner surface of the bore until the flat surface of the inner seal band becomes convex by flexure of the inner band under pressure in said bore.

2. A rodless power cylinder as set forth in claim 1, wherein the depth of the recess and the width of the inner seal band is determined in such a manner that the inner surface of the inner seal band lies flush with the slit-side inner surface when the edges of the inner seal band contact the surface of the recess under the condition where the inner seal band is not deflected.

3. A rodless power cylinder as set forth in claim 1, wherein the piston packing is an annular shape and is provided with an outer lip for contacting with the inner surface of the bore and wherein swelled portions are formed on the back side of the outer lip at the positions facing the inner seal band in order to increase the thickness of the outer lip.

4. A rodless power cylinder as set forth in claim 3, wherein a bulging portions are formed on the outer periphery of the outer lip of the piston packing at the portions facing the transverse edges of the inner seal band and said bulging portions are shaped in such a manner that the bulging portions fill the cavities formed by the surface of the recess and the edges of the inner seal band.

5. A rodless power cylinder as set forth in claim 4, wherein the bulging portions and the swelled portions of the outer lip of the piston packing are formed continuously with each other.

6. A rodless power cylinder as set forth in claim 3, wherein the outer diameter of the outer lip at the portion where the outer lip contacts the counter-slit-side inner surface is larger than the outer diameter of the outer lip at the portion where the outer lip contacts the slit-side inner surface.

7. A rodless power cylinder as set forth in claim 1, wherein both ends of the tube are closed by end members and wherein an internal elastomer damper is interposed between the piston end and the end member to receive the piston end at the stroke end of the piston and an external elastomer damper is interposed between the external moving body and the end member to receive the external moving body at the stroke end of the external moving body.

8. A rodless power cylinder as set forth in claim 7, wherein at least one of the internal damper and the external damper is provided with a protruding portion which abuts its corresponding moving body in order to absorb the kinetic energy thereof and wherein the protruding portion and both dampers are disposed in such a manner that after the protruding portion of one of the dampers abuts its corresponding moving body, the other damper abuts its corresponding moving body.

9. A rodless power cylinder as set forth in claim 8, wherein a plurality of the protruding portions having different amounts of protrusions are provided on at least one of the internal damper and the external damper.

10. A rodless power cylinder as set forth in claim 8, wherein the protruding portion of at least one of the dampers is formed by an protruding member made of elastomer which is inserted into a fitting hole formed on the end member and wherein the size of the fitting hole is larger than the cross section of the protruding member in order to allow the protruding member to expand in the lateral direction thereof when the protruding member absorbs the kinetic energy of the corresponding moving body.

11. A rodless power cylinder as set forth in claim 7, wherein the end member is provided with an insert portion protruding from the end member and is inserted into the bore when the end member is fitted to the end of the tube and a cylinder gasket is disposed around the periphery of the insert portion and wherein the internal damper is attached to the insert portion in such a manner that the internal damper holds the cylinder gasket between the end member and the internal damper.

12. A rodless power cylinder as set forth in claim 1, wherein both ends of the tube are closed by end members having a insert portion inserted into the bore when the end member is fitted to the end of the tube and wherein an annular cylinder gasket is disposed around the periphery of the insert portion and wherein the cross section of the cylinder gasket is increased at the portion contacting the inner seal band.

13. A rodless power cylinder as set forth in claim 12, wherein bulging portions are formed on the outer periphery of the outer lip of the cylinder gasket at the portions facing the transverse edges of the inner seal band and said bulging portions are shaped in such a manner that the bulging portions fill the cavities formed by the surface of the recess and the edges of the inner seal band and wherein the portion of the cylinder gasket between the bulging portions and facing the inner seal band has a cross section smaller than the cross section of the bulging portions and larger than the cross section of other portions of the cylinder gasket.

14. A rodless power cylinder as set forth in claim 13, wherein the bore of the tube has an oblong shape cross section and the contour of the cylinder gasket is formed as an oblong shape matching the cross section of the bore.

15. A rodless power cylinder as set forth in claim 12, wherein a recess is formed on the side surface of the chord of the cylinder gasket between the outer and inner peripheries thereof at the portion contacting the inner seal band.

* * * * *